US008631945B1

(12) United States Patent
Cato

(10) Patent No.: US 8,631,945 B1
(45) Date of Patent: Jan. 21, 2014

(54) METHOD FOR SCREENING FINE INDUSTRIAL MINERALS USING A VIBRATING HIGH SPEED SCREENING UNIT

(76) Inventor: James N. Cato, Brenham, TX (US)

( * ) Notice: Subject to any disclaimer, the term of this patent is extended or adjusted under 35 U.S.C. 154(b) by 918 days.

(21) Appl. No.: 12/576,413

(22) Filed: Oct. 9, 2009

(51) Int. Cl.
*B07B 1/06* (2006.01)

(52) U.S. Cl.
USPC ..... 209/274; 209/18; 209/136

(58) Field of Classification Search
USPC ..... 209/18, 20, 136, 157, 274, 21
See application file for complete search history.

(56) References Cited

U.S. PATENT DOCUMENTS

| | | | | | |
|---|---|---|---|---|---|
| 265,398 | A | | 10/1882 | Esmond et al. | |
| 1,500,090 | A | | 7/1924 | Sturtevant | |
| 1,639,678 | A | | 8/1927 | Woodward | |
| 2,068,783 | A | * | 1/1937 | Wendell | 209/44 |
| 2,094,786 | A | * | 10/1937 | Flint | 34/164 |
| 2,631,733 | A | * | 3/1953 | Rowe et al. | 100/102 |
| 3,014,587 | A | * | 12/1961 | Philippovic | 209/326 |
| 3,106,522 | A | * | 10/1963 | Dauenhauer | 209/267 |
| 4,003,831 | A | | 1/1977 | Tishkov et al. | |
| 4,082,657 | A | * | 4/1978 | Gage | 209/311 |
| 4,144,619 | A | * | 3/1979 | White et al. | 19/304 |
| 4,420,391 | A | * | 12/1983 | Sharki | 209/403 |
| 4,642,180 | A | | 2/1987 | Kaufman | |
| 4,968,366 | A | * | 11/1990 | Hukki et al. | 156/153 |
| 5,032,210 | A | * | 7/1991 | Hukki et al. | 156/359 |
| 5,232,098 | A | | 8/1993 | St-Pierre et al. | |
| 5,341,939 | A | | 8/1994 | Aitchison et al. | |
| 5,392,925 | A | * | 2/1995 | Seyffert | 209/405 |
| 5,685,982 | A | * | 11/1997 | Foster | 210/385 |
| 6,155,428 | A | * | 12/2000 | Bailey et al. | 209/315 |
| 6,575,304 | B2 | | 6/2003 | Cudahy | |
| 6,769,550 | B2 | * | 8/2004 | Adams et al. | 209/399 |
| 6,845,868 | B1 | * | 1/2005 | Krush et al. | 209/365.4 |
| 7,175,027 | B2 | * | 2/2007 | Strong et al. | 209/405 |
| 7,581,647 | B2 | * | 9/2009 | Grichar et al. | 209/370 |
| 8,365,922 | B2 | * | 2/2013 | Kojima et al. | 209/157 |
| 2005/0133465 | A1 | * | 6/2005 | Derrick et al. | 210/780 |
| 2009/0206011 | A1 | | 8/2009 | Cudah | |
| 2010/0038291 | A1 | | 2/2010 | Sauser | |

FOREIGN PATENT DOCUMENTS

| | | | |
|---|---|---|---|
| EP | 238455 | A2 * | 9/1987 |

* cited by examiner

*Primary Examiner* — Stefanos Karmis
*Assistant Examiner* — Michael E Butler
(74) *Attorney, Agent, or Firm* — Buskop Law Group, PC; Wendy Buskop

(57) ABSTRACT

A method for screening mixed particulate into multiple sized particulate simultaneously in a low dust high safety environment.

7 Claims, 13 Drawing Sheets

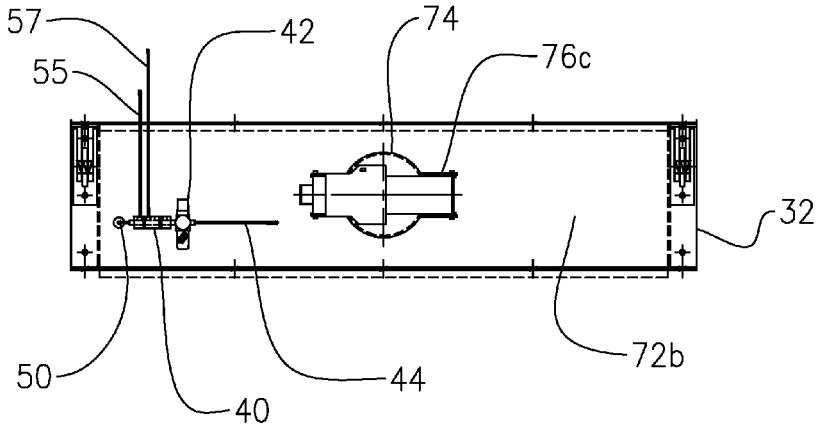
FIGURE 4
FIGURE 5
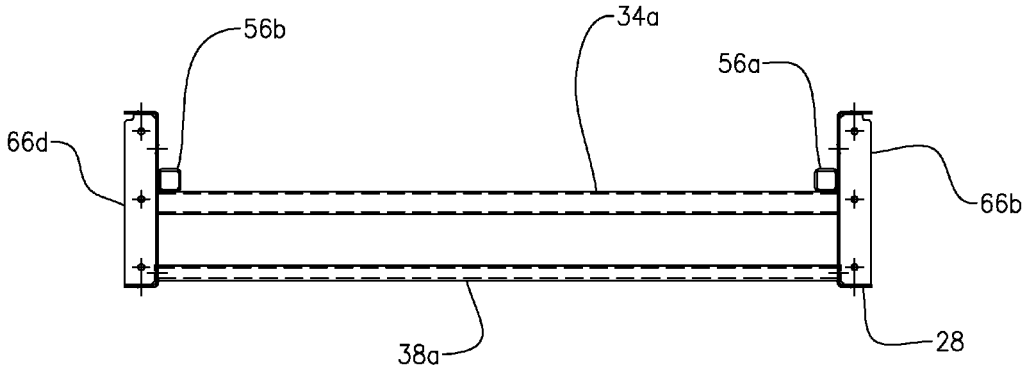

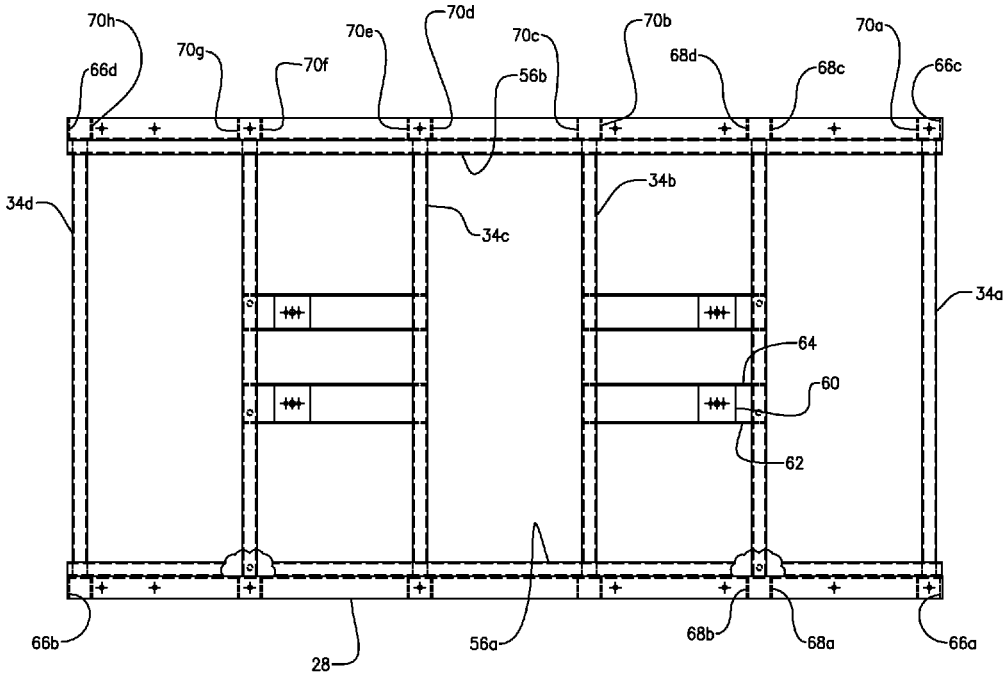
FIGURE 6A
FIGURE 6B
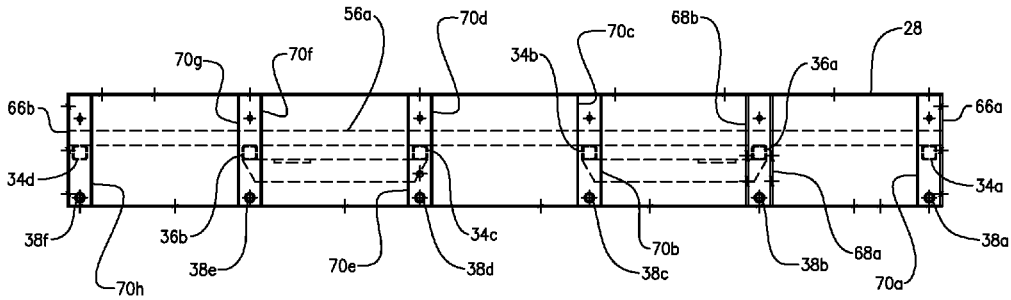

METHOD FOR SCREENING FINE INDUSTRIAL MINERALS USING A VIBRATING HIGH SPEED SCREENING UNIT

FIELD

The present embodiments generally relate to a method for screening particulate and fine material using a vibrating stackable high speed screening device for screening particulate by size simultaneously.

BACKGROUND

A need exists for a method for screening fine, closely graduated particulate that is fast, dust free and can produce multiple bins of particulate of different sizes simultaneously.

A need exists for a method of screening that can be used in new facilities or in existing screening facilities.

A need exists for a technique of screening that is more labor free and versatile than currently used methods at construction materials facilities.

A need exists for a method of screening that will prevent human harm during the screening of particulate.

The present embodiments meet these needs.

BRIEF DESCRIPTION OF THE DRAWINGS

The detailed description will be better understood in conjunction with the accompanying drawings as follows:

FIG. 4 is a front view of a screen frame usable with the method.

FIG. 5 is another front elevation of a screen frame usable with the method.

FIG. 6A is a top view of a screen frame.

FIG. 6B is a side view of a screen frame usable to perform the method.

Figure 1:
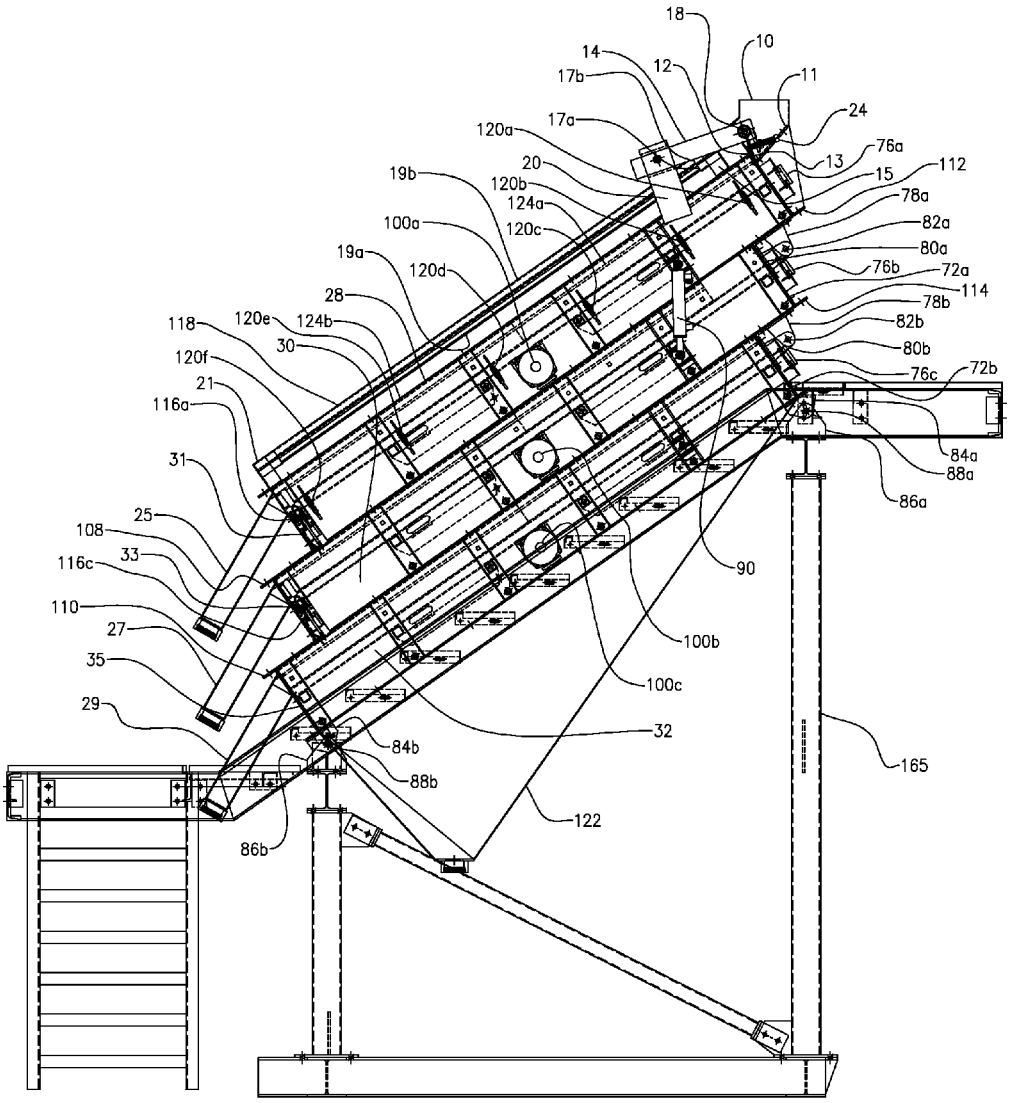
FIG. 1 is a side elevation view of a multi-deck vibrating stackable industrial mineral screening unit for screening multiple sizes of particulate simultaneously as detailed in the method.

The present embodiments are detailed below with reference to the listed Figures.

DETAILED DESCRIPTION OF THE EMBODIMENTS

Before explaining the present method in detail, it is to be understood that the method is not limited to the particular embodiments and that it can be practiced or carried out in various ways.

The present embodiments relate to a method for screening various sizes of particulate into multiple sized hoppers or other storage and conveying means, simultaneously using multi-deck vibrating stackable industrial mineral screening units. These units are also referred to herein as "particulate screen units" and "material screening units".

The present embodiments further relate to a method for screening particulate into at least two sizes of particulate quickly, in a dust free manner and in a low maintenance manner.

The method uses only a vibrating assembly, also referred to herein as the "vibrating screen tensioner" to move the screen cloth that screens the particulate, requiring less energy than systems and methods that also move frames and cloths together.

The embodiments provide an environmentally friendly method for workers of the facility, as the method produces less dust in the facility keeping the air of the workers clearer of particulate than other methods for sorting industrial minerals.

The method can be performed on equipment that can be of modular design, stackable with a cascading effect and using gravity to separate materials.

The method can contemplate using few lateral forces and few extreme motions as compared to currently available screening units. The method adds few dynamics, and requires the use of low amplitude oscillations that are useful in increasing facility capacity using existing support structures safely.

The method only moves the screen cloth instead of the metal frame. The method uses less energy and less electricity than other methods that move the frame.

The method maintains the parts of the assembly intact longer by using a lighter vibrational load.

The embodiments relate to a vibration based low dust producing method for screening particulate into at least two sizes, which has a variety of steps. The first step involves flowing mixed particulate having components with at least two different diameters through a feed inlet to an interior of a screen frame.

The screen frame has a discharge spout opposite the feed inlet. A first side wall and a second side wall are oriented parallel to each other between the discharge spout and the feed inlet forming the walls of the screen frame.

A plurality of compression cross members connect between the first side wall and the second side wall. The compression members can be made of steel 2 inch square tubing. The compression members can be between about 4 feet to about 6 feet long. The compression members can be attached to the side walls using welding.

A plurality of tensioner cross members can also connect between the first side wall and the second side wall.

A first air manifold cross member connects between the first side wall and the second side wall proximate to the feed inlet. A second air manifold cross member connects between the first side wall and the second side wall proximate to the discharge spout.

A plurality of air operated isolation mounts can be fixedly attached to the compression cross members using one air operated isolation mount support assembly. The air isolation mount support assembly can be made of two stiffeners and a mounting plate disposed between the compression cross members and the air operated isolation mounts.

A plurality of mounting blocks can also be used. Each mounting block can be fastened to an air operated isolation mount.

A vibrating screen tensioner can have a body, which can be unitary, supporting a vibrator motor, such as an A/C motor with variable vibrations run from a power supply.

The body is positioned over and connected to the mounting blocks over at least two, and up to eight compression cross members The body can be mounted at a 90 degree angle to the direction of material flow to enable more efficient screening of the industrial material.

The body can have a length longer than its width. The length can be between about 5 feet to about 12 feet. The width can have a dimension between about 12 inches to about 15 inches. The length extends from the feed inlet to the discharge spout, at a right angle to the compression cross members. The vibrating screen tensioner is in full contact with the screen cloth longitudinally, from feed inlet to discharge spout and at a right angle to the compression cross members.

The mounting of the vibrating screen tensioner is parallel to the material flow, which enables better materials stratification, such as enabling fines to travel down the center of a screen cloth and fall quickly through, while larger more coarse particulate moves to an outer edge of the screen cloth for removal via the discharge spout, still within the screen frame causing improved screening efficiency.

A screen cloth can be disposed within the screen frame above the vibrating screen tensionser and supported by the frame for receiving the mixed size particulate from the feed inlet.

An upper cover support extends from the first side wall to the second side wall adjacent the feed inlet. A lower cover support extends from the first side wall to the second side wall adjacent the discharge spout. The cover supports can be made of steel, such as a coated steel. The dust cover supported by the upper and lower cover supports can be made from a vinyl covered canvas.

Next in the method, air is supplied from the first and second air manifold cross members to the air isolation mounts to raise the mounts and the vibrating screen tensioner.

After the air isolation mounts are inflated, the vibration motor is energized to vibrate the vibrating screen tensioner and begin shaking the mixed size particulate allowing some of the particulate to fall through the screen cloth.

The next step involves flowing a first sized particulate, that is, a particulate having a certain diameter, such as between about −10 mesh to about +20 mesh out through the discharge spout from a first side of the screen cloth while flowing a second sized particulate, that is, a particulate having a certain diameter, which can be different from the first sized particulate, such as between about −20 mesh to about +40 mesh to either a second screen frame or to a hopper, such as a fines hopper.

The screen cloth is positioned within the screen frame beneath the upper cover support and lower cover support. Each support frame can have a different porosity screen cloth. The screen cloths can be made from woven stainless steel having a porosity that is selected depending on the needs of the customer.

In an embodiment, the screen cloth can be a one (1) layer screen cloth for screening of coarse particulate of about 6 mesh to about 20 mesh. For very fine particulate of about 20 mesh and finer, a second cloth can be used adjacent and in parallel to the first screen cloth, forming a "sandwich cloth" enabling very fine particulate screening in one screen frame.

To prevent dust from leaving the screen frame and mixing with air near the unit, a dust cover can be mounted to (i) the upper cover support that extends from the first side wall to the second side wall adjacent the feed inlet and (ii) the lower cover support that also extends from the first side wall to the second side wall adjacent the discharge spout.

Two or more screen frames can be connected together with a relocatable removable detachable lifting mechanism, enabling a first screen frame to be lifted from a second screen frame for servicing.

Two or more screen frames can be connected and stacked together to enable multiple sizes of particulate to be separated simultaneously, or more sizes, in groups of two sizes. If the units are stacked together, the units are inclined, and not horizontal to the ground for operation, to use gravity and less electricity to separate the particles. There are two products from one deck, three products from two decks of screen frames and so on.

Two or more screen frames can be connected and stacked together, but slightly offset from each other, that is, the second screen frame can be about 16 inches off set from the first screen frame, like a stair step, and the third screen frame can be offset by about 8 inches to about 20 inches from the second screen frame. If multiple screen frames are used, the motors of each screen frame are operated at the same time, synchronously and simultaneously from a motor controller allowing common oscillations to build in the units, creating en-harmonics, that is, synchronized vibrations between the units for maximum efficiency.

The method can contemplate that a first relocatable removable detachable lifting mechanism, such as a first hydraulic cylinder is connected to a first side of two screen frames disposed on top of each other. A second relocatable removable detachable lifting mechanism, such as a second hydraulic cylinder is connected to each second side of each of the screen frames opposite the first side. Using the lifting mechanisms at the same time, the first screen frame can be raised apart from the second screen frame for ease of maintenance, repair, screen cloth change or cleaning.

A step of the method can contemplate that a first screen frame can be connected to a second screen frame with at least two clevis assemblies. The clevis assemblies are bolted into place and removably secured to the first and second sides of a first screen frame.

These clevis assemblies are hinged to tang assemblies on the first and second sides of a second screen frame. The clevis and tang assemblies moveably hold the first screen frame to the second screen frame.

The first and second relocatable removable detachable lifting mechanisms can be activated and operated when hydraulic fluid is pumped to the lifting mechanisms. The hydraulic fluid can be a manual hand operated pump or controlled with an electronic controller connected to at least one valve.

Feed of mixed particulate can be controlled into the feed inlet using a balance gate that opens and closes with a first balance gate arm and a first counter weight connected to a second balance gate arm with a second counter weight and wherein the first and second balance gate arms are connected together with a balance gate axle.

The method can contemplate using a plurality of longitudinal supports within the screen frame each oriented to have a first end proximate to the feed inlet and a second end proximate to a discharge spout for supporting the screen cloth in the screen frame.

Another embodiment can contemplate installing an impact resistant and friction resistant liner on at least one side of the balance gate such as a ceramic liner, or a ceramic and glass liner.

The method has a step wherein dust is collected from the screen frame using a dust collection tap prior to ejecting particulate from at least one discharge spout.

Air is introduced from an outside source to each air operated isolation mounts simultaneously flowing air, which can be compressed air, to the first and second air manifold cross members and connecting the first and second air manifold cross members to the air operated isolation mounts.

The air operated isolation mounts are supported by a mounting plate and a first stiffener and a second stiffener between adjacent pairs of compression cross members and below each air operated isolation mount.

The method can contemplate the additional step of inspecting the screen cloth in the screen frame through an inspection/sampling port with a closable inspection/sampling port door in the screen frame.

An embodiment of the method stacks screen frames on top of each other but oriented in a stair step manner. The stair step stacked screen frames can be positioned on an angle on a support stand. The stair step stacked screen frames can be connected together with a latch assembly.

An embodiment of the method can further contemplate installing a plurality of screen cloth tension bars in the screen frame. Each screen cloth tension bar is oriented parallel to each first side and each second sides and wherein the screen cloth tension bars are oriented above the screen cloth for providing tension to the screen cloth.

Additionally, the method can contemplate installing a first screen frame transition plate to a first screen frame thereby engaging a second screen frame.

An embodiment of the method can further contemplate that each screen cloth tensioner bar that holds the screen cloth to the frame has an upper stiffener leg, an upper leg connected to the upper stiffener leg at about a 90 degree angle. The screen cloth tensioner bar also has a face plate connected to the upper leg at an angle between about 100 degrees to about 120 degrees. A lower leg is secured to the face plate at about a 90 degree angle. A tensioner bolt can extend through the face plate to engage the screen cloth tension bar.

Still another embodiment of the method can contemplate a method for screening two sizes of particulate using a vibrating screen cloth by flowing particulate onto a screen cloth extending from a feed inlet to a discharge spout in a screen frame using a screen frame that has a first side wall disposed between the feed inlet and the discharge spout; a second side wall oriented parallel to and opposite to the first side wall between the feed inlet and the discharge spout; a plurality of compression cross members connecting between the first side wall and the second side wall; a plurality of tension cross members connecting between the first side wall and the second side wall; a first air manifold cross member connecting between the first side wall and the second side wall proximate to the feed inlet; and a second air manifold cross member connecting between the first side wall and the second side wall proximate to the discharge spout.

The next step involves inflating a plurality of air operated isolation mounts. The air operated isolation mounts are disposed on the compression cross members. The air operated isolation mount support a mounting block.

The next step involves vibrating a vibrating screen tensioner having a body using a vibrator motor. The vibrator motor in each screen frame vibrates the vibrating screen tensioner allowing particulate sized to fall through the screen cloth of the first screen frame to the second screen frame while simultaneously discharging a predetermined diameter particulate through the discharge plate connected to a discharge spout to a hopper, conveyor or another storage unit.

As a next step, dust is prevented from escaping the screen frame by disposing a dust cover over a upper cover support extending from the first side wall to the second side wall adjacent the feed inlet. The dust cover also goes across a lower cover support extending from the first side wall to the second side wall adjacent the discharge spout.

When the vibrator motor vibrates, the mixed particulate flows onto the screen cloth and a first sized particulate falls through the screen cloth to a first container while discharging a second sized particulate with a diameter larger than the screen cloth to the discharge spout.

Other features of the stacked assembly can be secured to this single screen frame version.

In FIG. 1, a first screen frame 28 is disposed on a second screen frame 30. The second screen frame is disposed on a third screen frame 32.

Each of the screen frames has a discharge plate. The upper screen frame has upper screen discharge plate 31, the middle screen frame has a middle screen discharge plate 33, and the bottom screen has a bottom screen discharge plate 35.

Each discharge plate is shown connected to a discharge spout 25, 27, 29 for passing particles of a predetermined size from each of the screen frames to a hopper, a conveyor or another storage unit.

Each discharge spout of a multi-deck unit will flow a different particle size from the other discharge spouts. For example, particles from the top discharge spout 25 can have a diameter between −10 mesh to +20 mesh, while particles from the middle discharge spout 27 have a diameter between −20 mesh to +30 mesh and particles from the bottom discharge spout 29 have a diameter between −30 mesh to +40 mesh.

In this Figure, the first screen frame 28 has a feed inlet 10, which also has a balance gate 12. The balance gate 12 can be operated by two balance gate arms, balance gate arm 14 is shown. The balance gate arms each have a balance gate counter weight. Balance gate counter weight 20 is shown for balance gate arm 14. The balance gate arms are pivoted on a balance gate axle 18.

The feed inlet 10 can have a liner 11 for longer life for the feed inlet. The liner can be an abrasion resistant liner.

The balance gate has a balance gate stop 24. The balance gate stop can be an adjustment bolt with a nut on a fabricated bracket for limiting the travel of the balance gate opening to spread the particulate mix over the full width of the screen cloth.

An upper cover support 15, in an embodiment, can be fabricated into the feed inlet. A lower cover support 21 is also shown connected to the frame.

The dust cover is also shown, supported by cover support holders 17*a*, 17*b*, but additional cover support holders can also be used. Longitudinal supports 19*a*,19*b* fit into the cover support holders. The longitudinal supports can be tubing that can have an inner diameter of between about 1 inch to about 1.5 inch square tubing.

End cover plates 108, 110 are shown enabling the support frames to stack in a staggered manner on each other.

Also shown in FIG. 1 is a first relocatable removable detachable lifting mechanism 90, which in this embodiment is shown as a hydraulic cylinder with piston rod that can be used to lift a first support frame above a second support frame for maintenance.

The first and second screen frames can be connected with latches 116*a*, 116*c* which can be ones made by Destaco™ of the USA.

The screening unit is shown supported on a frame 165 allowing the screen frames to be inclined rather than flat for allowing gravity to facilitate conveying particles down the screen cloth using less electricity than flat based units.

The first screen frame 28, is further shown with an inspection/sampling port door 76*a*, second screen frame 30 has inspection/sampling port door 76*b*, and third screen frame 32 has inspection/sampling port door 76*c*.

Also depicted in this Figure is fines hopper 122, the dust cover latch assemblies 120*a*, 120*b*, 120*c*, 120*d*, 120*e*, 120*f* and the dust cover 118.

Also shown in FIG. 1 is the balance gate liner 13 for the balance gate 12. The balance gate liner can be made of the same material and can have the same thicknesses as the feed inlet liner.

A first screen frame transition plate 112 is depicted between the first and second deck.

It can be noted that deck to deck, the latches 116*a*, 116*c* can hold the decks together.

FIG. 1 additionally shows two of the clevis assembly 78*a*, 78*b* which connect to the tang assembly 80*a*, 80*b* in a rotating or hinged construction.

FIG. 1 shows the receiver end plates 72*a*, 72*b*, which are also usable herein. Frame mounts are shown as frame mount tops 84*a*, 84*b*. Frame mount bottoms 86*a*, 86*b*, frame mount pins 88*a*, 88*b* and pins 82*a*, 82*b* are also are depicted.

Screen cloth tensioner bars 124*a*, 124*b* that apply tension to the hook strip of the screen cloth are shown.

Vibrator motors 100*a*, 100*b*, 100*c* which attach to the vibrating screen tensioner are also shown.

Figure 2:
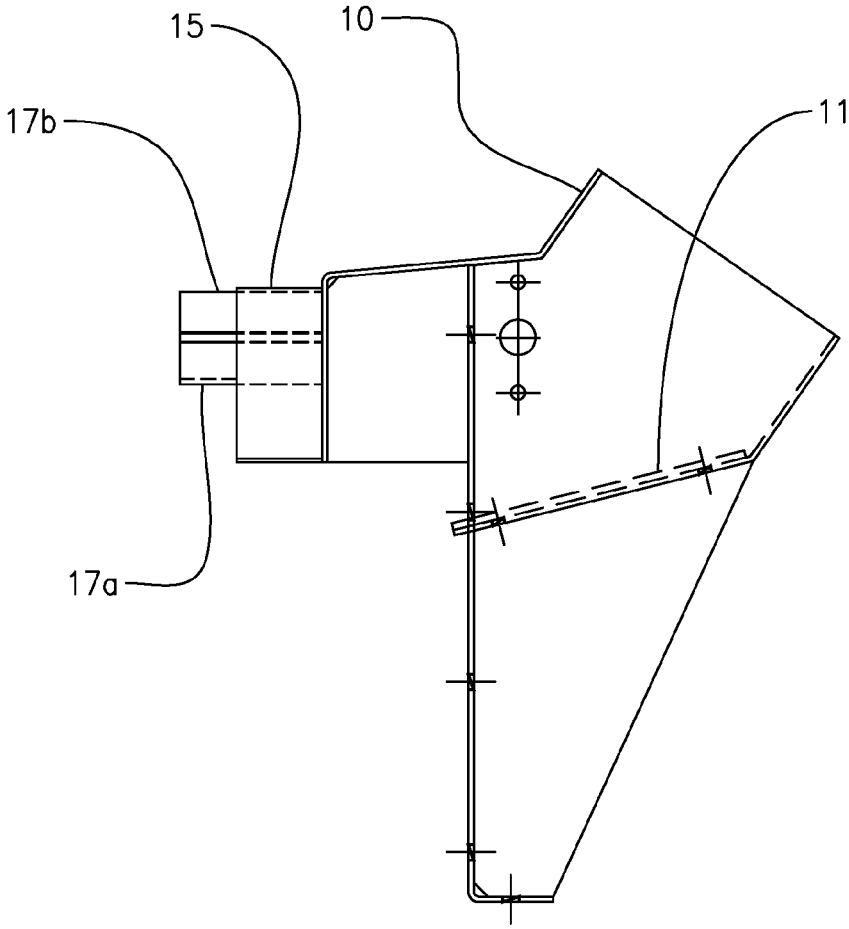
FIG. 2 is a detail of a feed inlet with a liner usable in the screening unit.

FIG. 2 shows a detail of the feed inlet 10 having a liner 11. The liner can be a liner on the bottom of the feed inlet or on the side of the feed inlet, or on all sides and bottom of the feed inlet. The liner can be made of a ceramic/glass composite. The thickness of the liner can range from about 0.125 inch to about 1 inch.

FIG. 2 also shows the upper cover support 15 and the cover support holders 17*a*, 17*b*.

Figure 3:
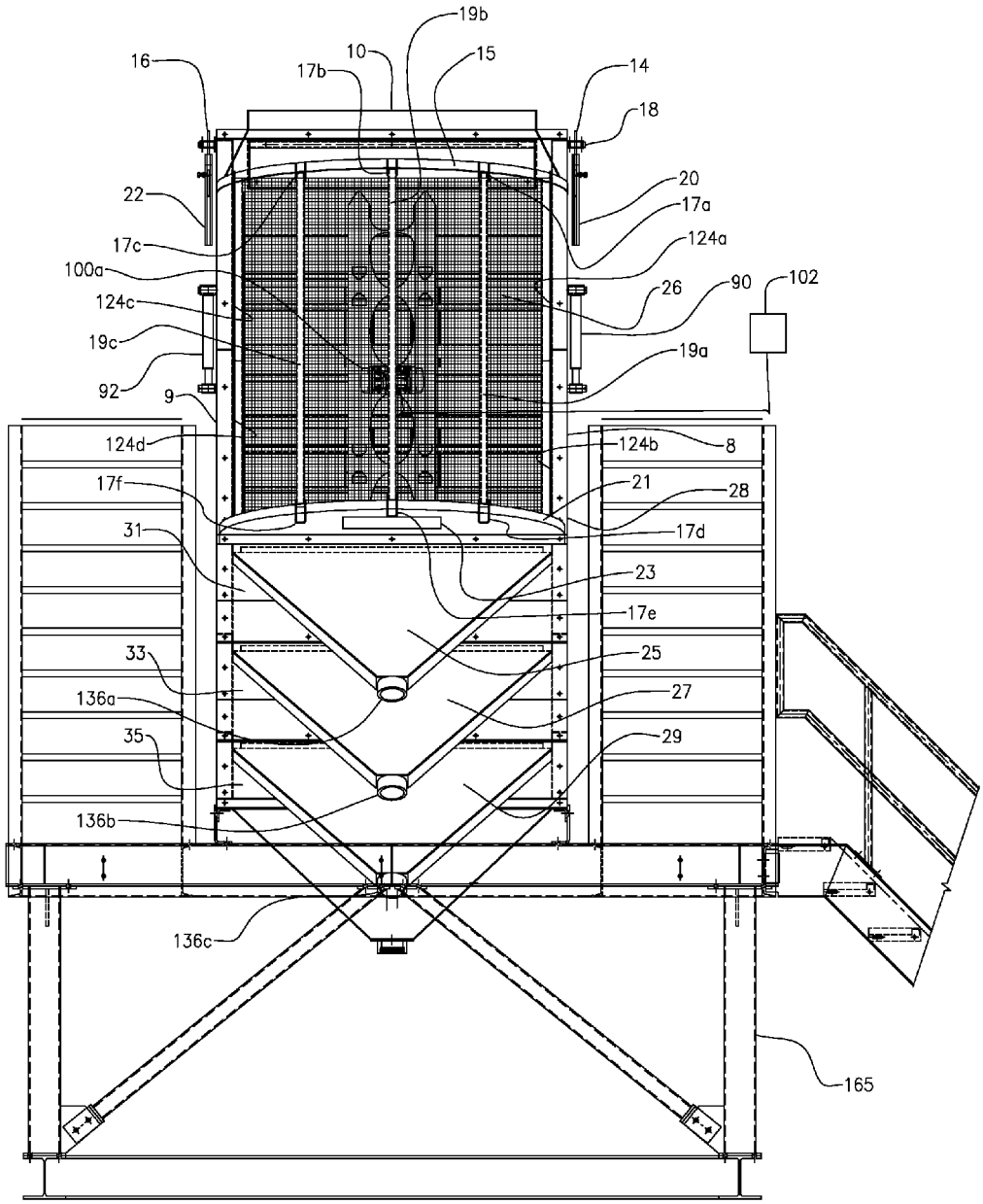
FIG. 3 is a front elevation of an embodiment of a multi-deck vibrating stackable industrial mineral screening unit that can perform the described method.

FIG. 3 shows the support frame sides 8, 9. Within the support frame sides, vibrator motor 100*a* for the screen frame is shown.

FIG. 3 also shows a front elevation of the multi-deck of FIG. 1 and further depicts the balance gate arms 14, 16 connected by the balance gate axle 18 between the arms. A bearing can be used on each side of the balance gate axle.

The balance gate counterweights 20, 22 are also shown. Discharge spouts 25, 27, 29 are also shown more clearly in this Figure. Each discharge spout in FIG. 3 has a coupling 136*a*, 136*b*, 136*c* for engaging a fitting that attaches to a hose for removing the sized particulate.

FIG. 3 has a first relocatable removable detachable lifting mechanism 90 and a second relocatable removable detachable lifting mechanism 92, which can be hydraulic.

Also shown in FIG. 3 are feed inlet 10, upper cover support 15, cover support holders 17*a*, 17*b*, 17*c* as well as cover support holders 17*d*, 17*e*, 17*f*. Longitudinal supports 19*a*, 19*b*, 19*c* are also shown and can be inserted into the cover support holders. Longitudinal support covers can be used to support the dust cover, which is not shown in this embodiment.

Also shown is the dust collection tap 23 for flowing dust from under the dust cover to a container to prevent explosions from the dust. Dust can be extremely explosive in a contained space, and the tap, prevents explosions. The invention provides safer air for employees and can help prevent silicosis, which is a form of occupational lung disease caused by inhalation of crystalline silica dust FIG. 3 also shows first screen frame 28 with the screen cloth 26 in the frame. Screen discharge plates 31, 33, 35 are also depicted which can be $3/16^{th}$ inch in thickness, that are about 5 foot 6 inches wide and about 16 inches high for transitioning the end of the screen deck to a discharge spout.

Screen cloth tension bars 124*a*, 124*b*, 124*c*, 124*d* hold the screen cloth to the screen frame.

The vibration motor of each screen frame can be in communication and can be controlled by a motor controller 102, which can also be centralized.

The stacked assembly is shown on the support frame 165.

FIG. 3 has the upper cover support 15 and the lower cover support 21 which in this embodiment are arched for supporting the dust cover and preventing dust from escaping the screen frame into the air near the unit. The dust cover prevents harm to the operators of the unit.

FIG. 4 shows an air supply 55 to the middle of the screen frame. An air supply 57 to the top screen of the screen frame is also shown.

A receiver end plate 72*b* of the lower deck, or bottom deck is depicted in this Figure. Also shown is an inspection/sampling port 74, which can be sealable and can further be located in the lower screen frame with inspection/sampling port door 76*c*.

FIG. 4 further shows an air manifold 40 connected to an air regulator 42 which engages an air source 44 that can be a compressed air source. The air manifold connects to first and second air manifold cross members, which are better depicted in FIG. 6B, and allows for simultaneous inflation of air operated isolation mounts. The third screen frame 32 and the air tube 50 from the air manifold cross member are also depicted.

FIG. 5 shows a cross sectional elevation of the first screen frame 28. In this Figure the compression cross member 34*a* can be seen positioned above the tension cross member 38*a*. A first screen cloth base support 56*a* is shown as well as a second screen cloth base support 56*b*. End plates 66*b*, 66*d* are shown.

FIG. 6A is a top view of the first screen frame 28. This Figure shows the compression cross members 34*a*, 34*b*, 34*c*, 34*d*. Also shown are screen cloth base supports 56*a*, 56*b*.

End plates 66*a*, 66*b*, 66*c*,66*d* for the screen frame are shown. Up to 4 end plates can be used for each screen frame. Additional stiffeners can be used in the screen frame, including cylinder mount stiffeners, 68*a*, 68*b*, 68*c*, 68*d*, which are also shown and up to 4 can be used per screen frame. Frame stiffeners 70*a*, 70*b*, 70*c*, 70*d*, 70*e*, 70*f*, 70*g*, 70*h* are shown and up to 16 can be used per screen frame.

The mounting plate 60 and its associated first stiffener 62 and second stiffener 64 are also shown.

Figure 7:
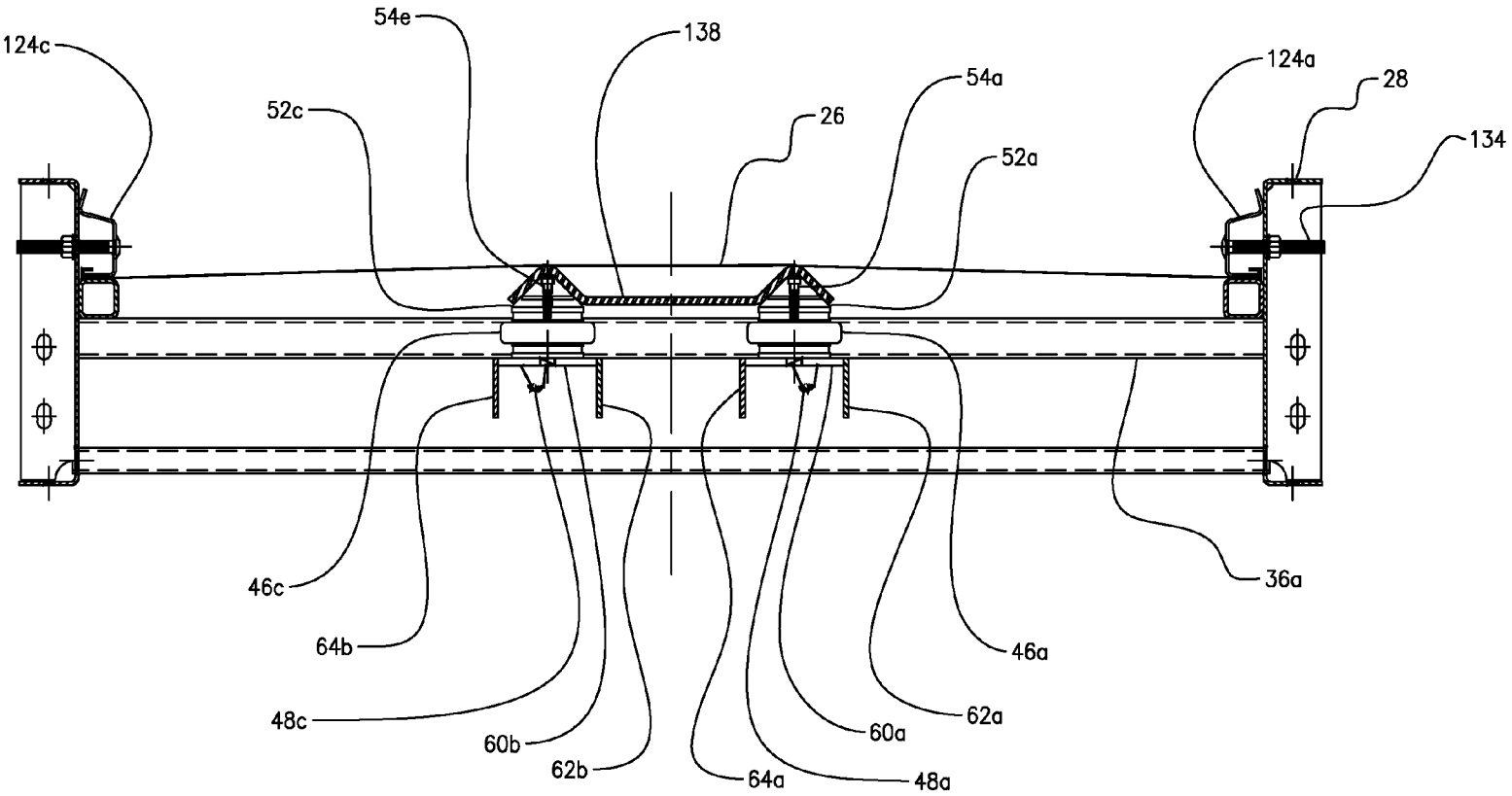
FIG. 7 is a detail of an air operated isolation mount usable with the method.

Mounted to the mounts shown in FIG. 6A are the air operated isolation mounts provided in detail in FIG. 7.

FIG. 6B is a side view of first screen frame 28 and depicts the tension cross members 38*a*, 38*b*, 38*c*, 38*d*, 38*e*, 38*f*. Also shown are the first and second air manifold cross members 36*a*, 36*b* that supply air to air operated isolation mounts that are depicted in a later Figure.

FIG. 6B shows compression cross members 34*a*, 34*b*, 34*c*, 34*d* and the frame stiffeners 70*a*, 70*b*, 70*c*, 70*d*, 70*e*, 70*f*, 70*g*, 70*h* are also depicted. The first screen cloth base support 56*a*, cylinder mount stiffeners 68*a*, 68*b* and end plates 66*a*, 66*b* are also depicted.

FIG. 7 shows the screen cloth 26 in first screen frame 28 and the first air manifold cross members 36*a*.

A first and second tube 48*a*, 48*c* provide air from the air manifold cross member to each air operated isolation mount.

FIG. 7 also depicts an air operated isolation mounts 46*a*, 46*c* connected to mounting blocks 52*a*, 52*c*. The mounting blocks can each be made of a phenolic compound. The mounting can be accomplished using isolation mount fasteners 54*a*, 54*e*, which can be threaded in an embodiment.

Two mounting plates 60*a*, 60*b* are also shown each having a first stiffener 62*a*, 62*b*. A second set of stiffeners 64*a*, 64*b*.

Screen cloth tension bars 124*a*, 124*c* are shown for tensioning the screen cloth. A tensioning bolt 134 and the vibrating screen tensioner 138 are also depicted.

Figure 8A:
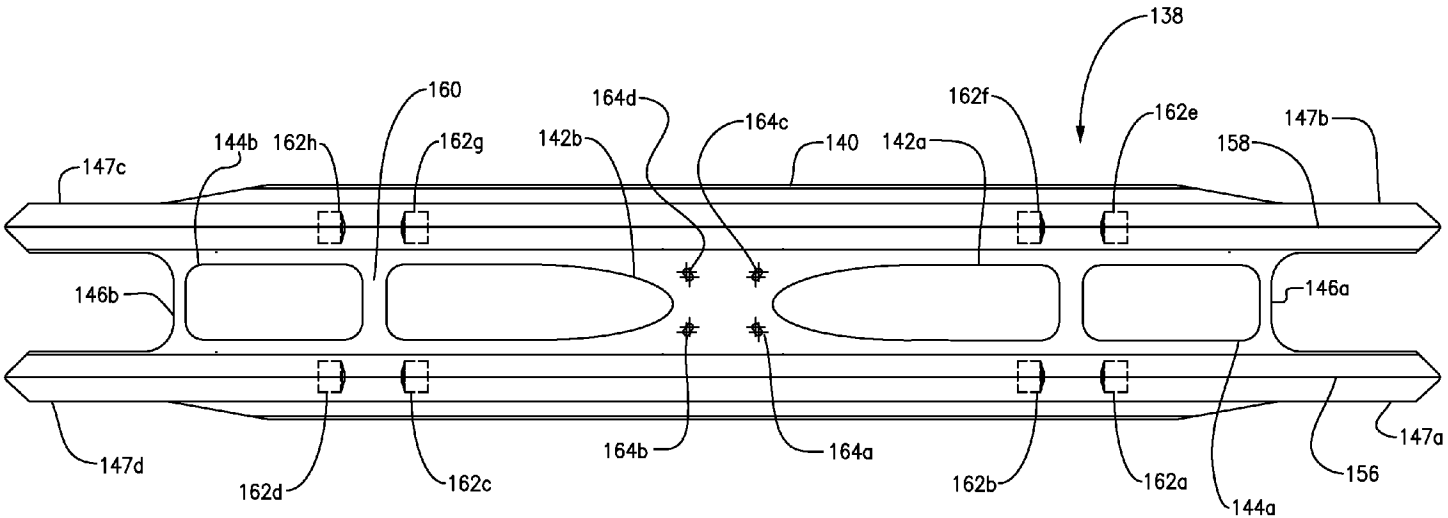
FIG. 8A is a top view of a vibrating screen tensioner usable in the method.

FIG. 8A is a top view of a vibrating screen tensioner usable herein.

The vibrating screen tensioner 138 can have a body 140, which can be unitary, and rectangular, with a pair of central perforations 142*a*, 142*b*, a pair of end perforations 144*a*, 144*b* and a pair of end cut outs 146*a*, 146*b*. The end cut outs form rib extensions 147*a*, 147*b*, 147*c*, 147*d*.

Clips 162*a*, 162*b*, 162*c*, 162*d*, 162*e*, 162*f*, 162*g*, 162*h* are shown for holding the ribs to mounting blocks in the screen frame.

Mounting holes 164*a*, 164*b*, 164*c*, 164*d* for mounting fasteners are shown for holding the vibration motor to the vibrating screen tensioner. A slotted hole can be used herein enabling the mounting of many different vibrator motors into one assembly.

A first rib 156 is shown as well as second rib 158 with the connecting segment 160.

Figure 8B:
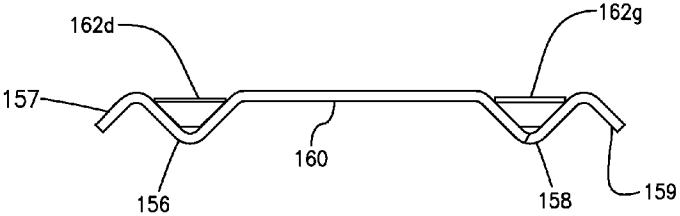
FIG. 8B is a side view of a vibrating screen tensioner usable in the method.

FIG. 8B is a side view of a vibrating screen tensioner 158 having a first flange 157 connected to a first rib 156. A second flange 159 is connected to a second rib 158. A connecting segment 160, which can be generally planar, connects the first rib with the second rib. Clips 162*d* and 162*g* are also shown.

The first and second ribs rise above the connected segment, to an elevation of between about 1 inch to about 3 inches in a generally triangular construction.

Figure 9:
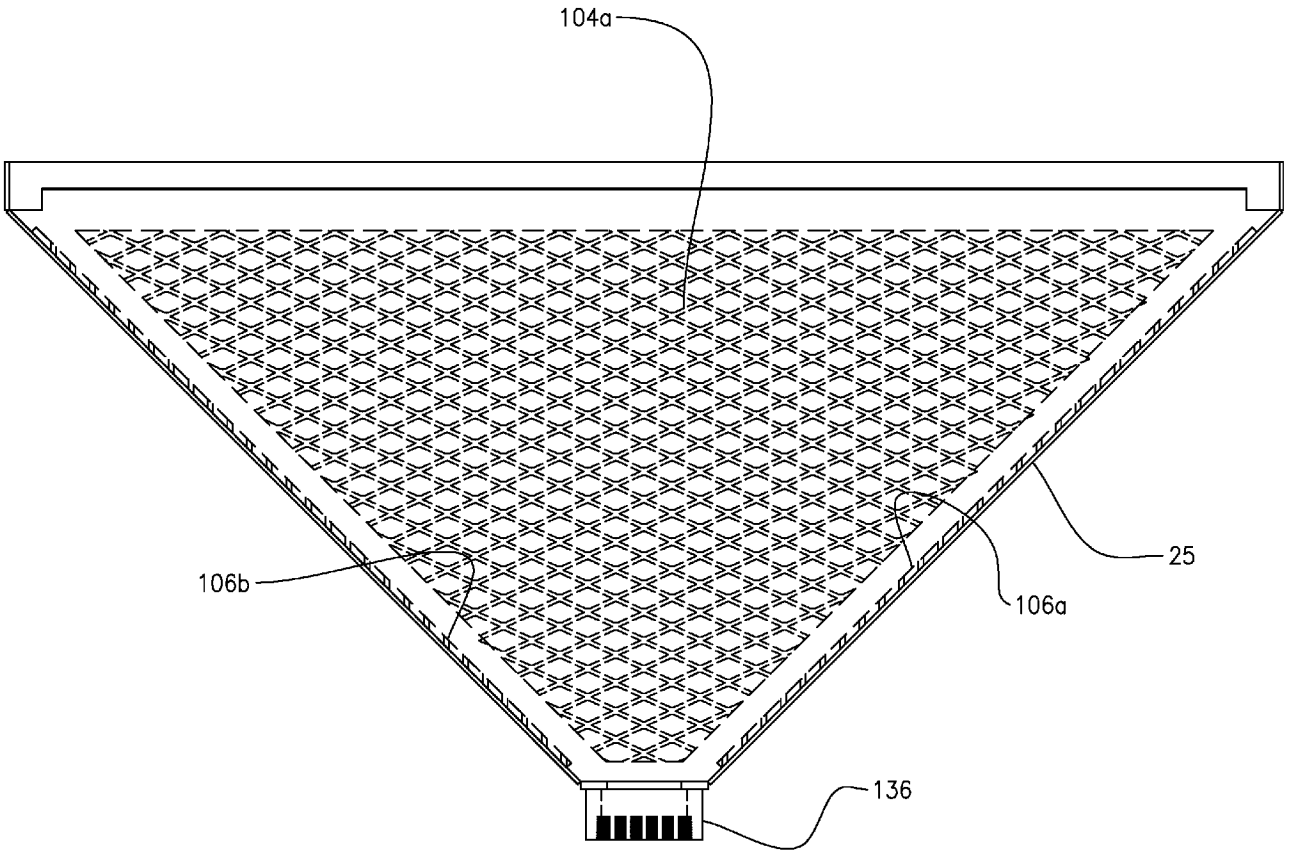
FIG. 9 is a plan view of a discharge spout with liner usable to perform the method.

FIG. 9 is a detail of a discharge spout 25 with discharge spout liner. In this embodiment is shown a top discharge spout liner 104*a*, a first discharge spout side 106*a* and a second discharge spout side 106*b*. A second top discharge spout liner is not shown in this Figure. A half coupling 136 for coupling the spout to a hose is also shown.

Figure 10:
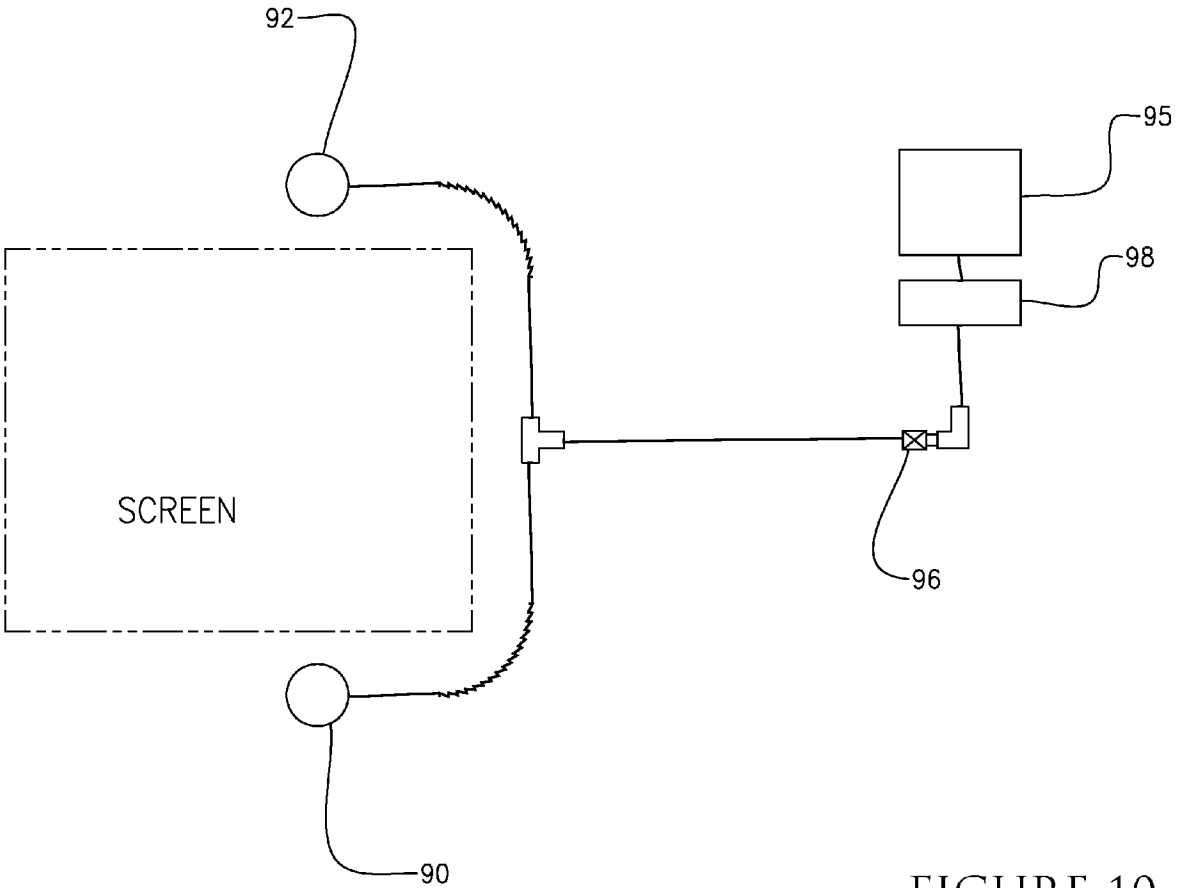
FIG. 10 is a diagram of a hydraulic configuration usable with the method.

FIG. 10 shows a diagram of a hydraulic configuration of the first and second relocatable removable detachable lifting mechanisms 90, 92, which can be hydraulic cylinders, connected between screen frames connected to a control valve 96 and a hydraulic pump 98 connected to a hydraulic reservoir 95.

Figure 11:
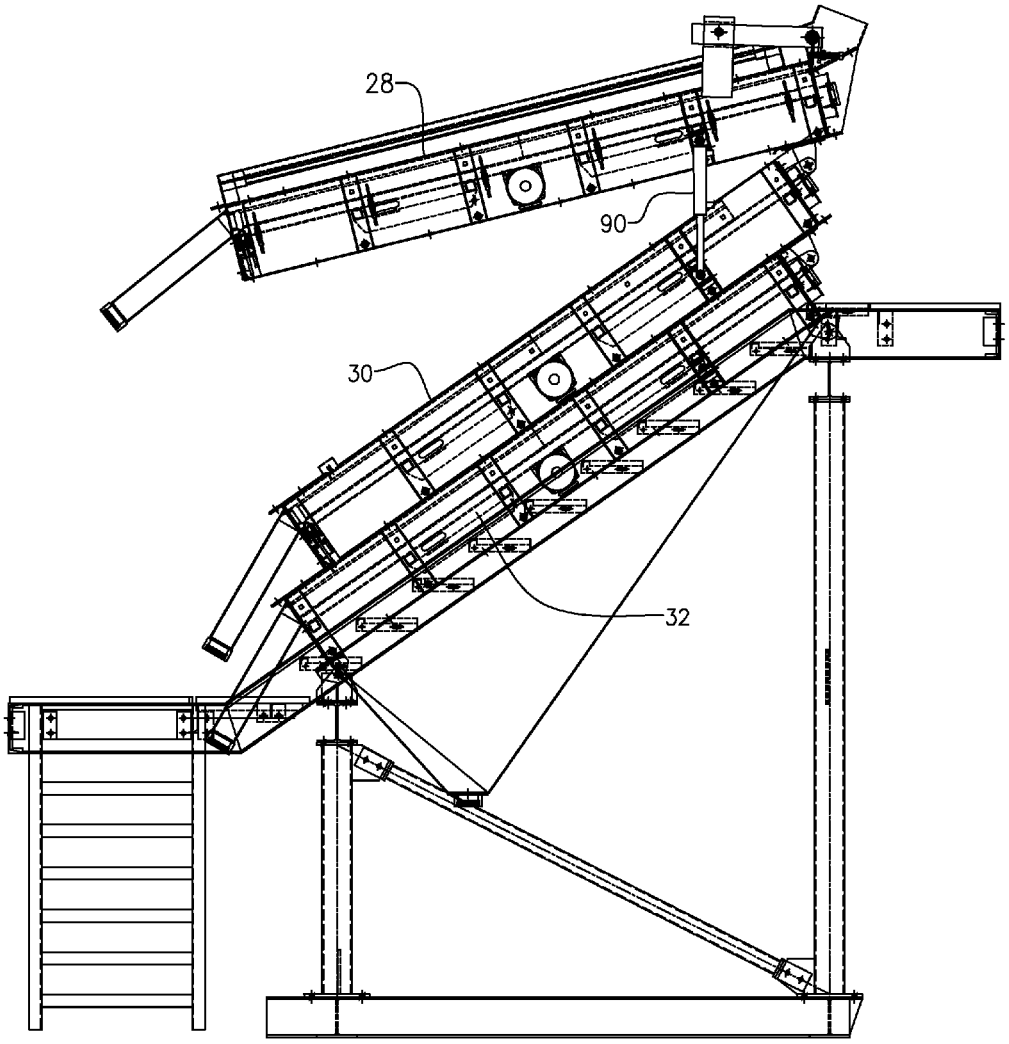
FIG. 11 is a detail of a multi-stacked screening unit.

FIG. 11 shows a first screen frame 28 held apart from second screen frame 30 using a first relocatable removable detachable lifting mechanism 90 while sitting on the third screen 32.

Figure 12:
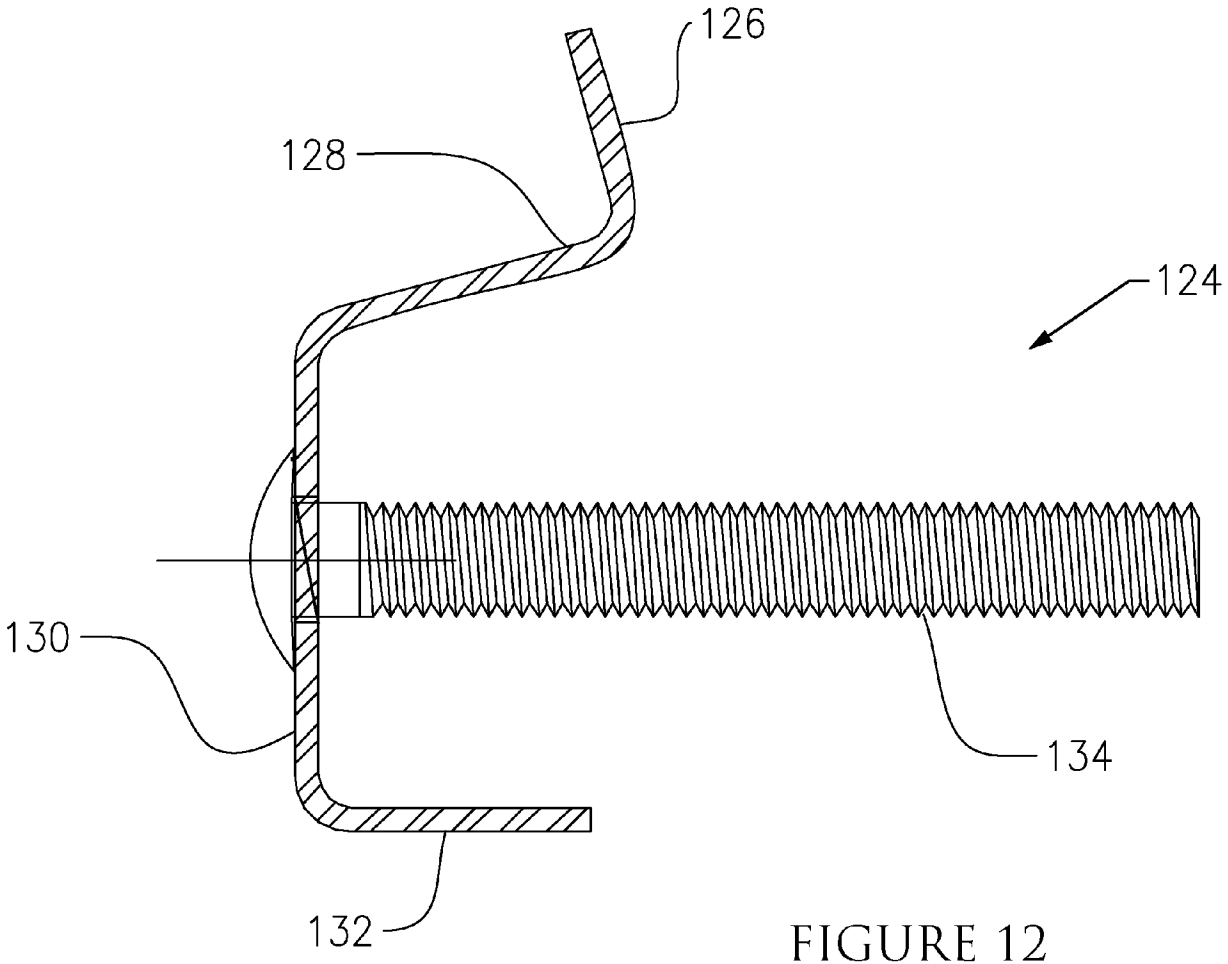
FIG. 12 is a side view of a screen cloth tension bar usable with the method.

FIG. 12 shows a side view of a screen cloth tension bar 124. The screen cloth tension bar has an upper stiffener leg 126 connected to an upper leg 128. A face plate 130 engages the upper leg 128. A lower leg 132 engages the face plate 130. A tensioning bolt 134 passes through the face plate 130 for tensioning as a bent plate.

Figure 13A:
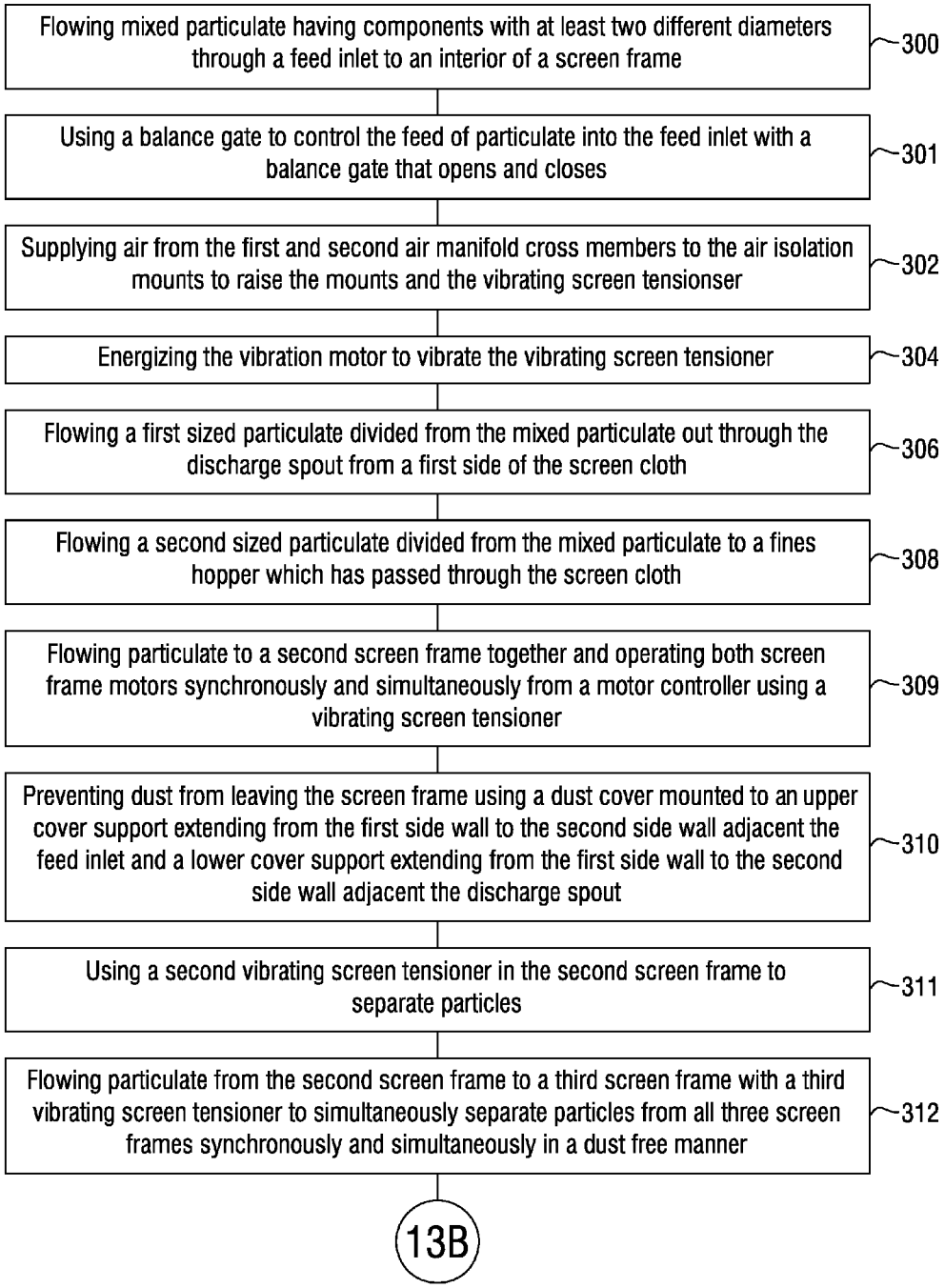
FIG. 13A and FIG. 13B is a flow diagram of the steps of the method.
Figure 13B:
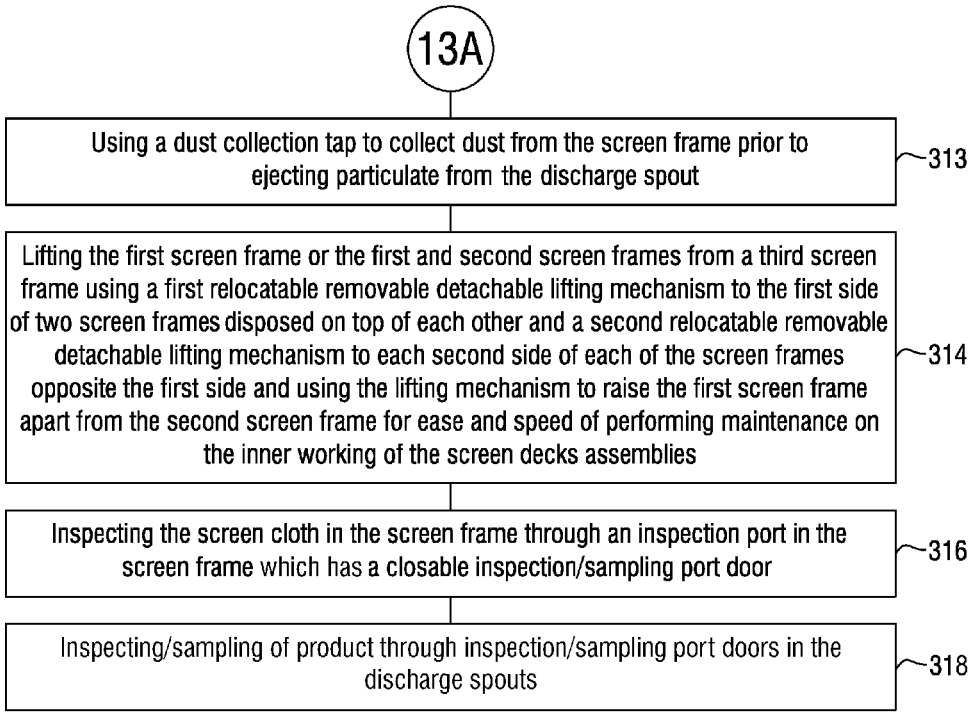

FIG. 13A and FIG. 13B is a flow diagram of the method steps of the invention.

Step 300 involves flowing mixed particulate having components with at least two different diameters through a feed inlet to an interior of a screen frame.

Step 301 can be used in an embodiment, which involves using a balance gate to control the feed of particulate into the feed inlet with a balance gate that opens and closes.

Step 302 involves supplying air from the first and second air manifold cross members to the air isolation mounts to raise the mounts and the vibrating screen tensioner.

Step 304 involves energizing the vibration motor to vibrate the vibrating screen tensioner.

Step 306 involves flowing a first sized particulate divided from the mixed particulate out through the discharge spout from a first side of the screen cloth.

Step 308 involves flowing a second sized particulate divided from the mixed particulate to a fines hopper which has passed through the screen cloth.

Step 309 involves flowing particulate to a second screen frame together and operating both screen frame motors synchronously and simultaneously from a motor controller using a vibrating screen tensioner.

Step 310 involves preventing dust from leaving the screen frame using a dust cover mounted to an upper cover support extending from the first side wall to the second side wall adjacent the feed inlet and a lower cover support extending from the first side wall to the second side wall adjacent the discharge spout.

Step 311 can involve using a second vibrating screen tensioner in the second screen frame to separate particles.

Step 312 involves flowing particulate from the second screen frame to a third screen frame with a third vibrating screen tensioner to simultaneously separate particles from all three screen frames synchronously and simultaneously in a dust free manner.

Step 313 involves using a dust collection tap to collect dust from the screen frame prior to ejecting particulate from the discharge spout.

Step 314 involves lifting the first screen frame or the first and second screen frames from a third screen frame using a first relocatable removable detachable lifting mechanism to the first side of two screen frames disposed on top of each other and a second relocatable removable detachable lifting mechanism to each second side of each of the screen frames opposite the first side and using the lifting mechanism to raise the first screen frame apart from the second screen frame for ease and speed of performing maintenance on the inner working of the screen decks assemblies.

Step 316 involves inspecting the screen cloth in the screen frame through an inspection/sampling port in the screen frame which has a closable inspection/sampling port door.

Step 318 can involve inspecting/sampling of product through inspection/sampling port doors in the discharge spouts.

It can be noted that the screen cloth is crowned from side to side in this method. Crowning of the cloth assists in the stratification of the particulate to be screened resulting in more efficient screening.

The screen in a method can be installed at an angle just greater than the particulate's materials angle of response. The screen can be installed at any angle needed to facilitate the differences in different material.

While these embodiments have been described with emphasis on the embodiments, it should be understood that within the scope of the appended claims, the embodiments might be practiced other than as specifically described herein.

What is claimed is:

1. A method of making a screen assembly to be used for screening particulate comprising: forming a first screen frame between the first feed inlet and a first discharge spout; wherein forming the first screen frame comprises:

(i) connecting one or more tension cross members with a first side wall and a second side wall;

(ii) connecting at least two compression cross members with the first side wall and the second side wall;

(iii) connecting at least two air manifold cross members with the first side wall and the second side wall, wherein the at least two compression cross members are between the at least two air manifold cross members;

(iv) connecting a first screen cloth base support with the first side wall;

(v) connecting a second screen cloth base support with the second side wall;

(vi) placing a screen cloth on the first screen cloth base support and the second base support;

(vii) using at least a first tension bar and a second tension bar to tension the screen cloth;

(viii) connecting an isolation mount with one of the two compression cross members and one of the at least two air manifold cross members;

(ix) connecting another isolation mount with the other of the two compression cross members and the other of the at least two air manifold cross member; and (x) supporting a vibrating screen tensioner with the isolation mounts; wherein the vibrating screen tensioner comprises a side having a first flange connected to a first rib and another side having a second flange connected with a second rib; wherein supporting the vibrating tensioner with the isolation mounts includes engaging a first set of clips with the first rib and a second set of clips with the second rib, wherein the vibrating screen tensioner supports a vibrating motor, wherein the vibrating screen tensioner engages the screen cloth, wherein adjusting the isolation mount tightens the screen cloth, and wherein the vibrating screen tensioner vibrates the screen cloth.

2. The method of claim 1, wherein the vibrating tensioner comprises a body, which is generally rectangular, with a pair of central perforations, a pair of end perforations and a pair of end cut outs wherein the end cut outs form a first, second, third and fourth rib extension.

3. The method of claim 2, wherein the body comprises a first flange connected to a first rib, a second flange connected to a second rib, and wherein the first and second ribs are parallel to each other and are connected by a generally planar connecting segment.

4. The method of claim 2, wherein the pair of central perforations are parabolic at one end and flat with radius curves at the other end, wherein the ends are connected by a straight portion or rectangular with radius corners at each end, and wherein the end cut outs are generally C-shaped.

5. The method of claim 1, further comprising operatively aligning a balance gate with the feed inlet.

6. The method of claim 5, further comprising installing a liner, which is impact and friction resistant, on at least one side of the balance gate.

7. The method of claim 1, further comprising providing air to each of the air operated isolation mounts simultaneously from an air supply flowing air to the first and second air manifold cross members and connecting the first and second air manifold cross members to the air operated isolation mounts.

* * * * *